United States Patent [19]

Green et al.

[11] 4,401,969

[45] Aug. 30, 1983

[54] TRAFFIC CONTROL SYSTEM

[76] Inventors: Gordon J. Green, 386 Ruth Ave., Willowdale, Ontario, Canada, M2M 2J2; Robert J. deBruyn, R.R. #4 Bloomington Side Rd., Stouffville, Ontario, Canada, L0H 1L0

[21] Appl. No.: 309,735

[22] Filed: Oct. 8, 1981

Related U.S. Application Data

[63] Continuation of Ser. No. 93,349, Nov. 13, 1979, abandoned.

[51] Int. Cl.[3] ..... G08G 1/00; G08G 1/097; G08B 21/00

[52] U.S. Cl. ..... 340/41 R; 340/40; 340/46; 340/636; 340/642

[58] Field of Search ..... 340/32, 46, 636, 35, 340/41 R, 40, 37, 664, 638, 641, 645, 642, 653, 825.69, 825.57, 825.72, 696, 41 A; 455/99, 95

[56] References Cited

U.S. PATENT DOCUMENTS

| | | | |
|---|---|---|---|
| 2,832,060 | 4/1958 | Hendricks et al. | 340/40 |
| 3,015,802 | 1/1962 | Newsom | 340/40 |
| 3,119,093 | 1/1964 | Willyard | 340/40 |
| 3,247,482 | 4/1966 | Lesher | 340/32 |
| 3,902,156 | 8/1975 | Hill | 340/46 |

*Primary Examiner*—James J. Groody

*Attorney, Agent, or Firm*—Hirons, Rogers & Scott

[57] ABSTRACT

In a portable traffic control system in which receivers are controlled from a central transmitter the carrier signal employed is modulated by two different modulation signals in order to command a green light to be shown, reducing the possibility of this happening accidentally. The receipt of a carrier signal with only a single pilot modulation causes production of a red signal. An amber caution light if present is lit automatically upon turning off green, and flashing amber is produced by switching on green and then turning it off before the green can be lit. A drop in battery voltage below a predetermined level will cause a flashing red signal to warn and conserve the battery power. A non-resettable link in circuit with the green light is broken upon existence of a malfunction condition whereby another light is lit while green is alight, so that the green can no longer be lit until the unit is serviced to remove the malfunction.

24 Claims, 7 Drawing Figures

TRAFFIC CONTROL SYSTEM

CROSS-REFERENCE TO RELATED APPLICATION

The present application is a continuation of our earlier application Ser. No. 093,349, filed Nov. 13, 1979, now abandoned.

Field of the Invention

The present invention is concerned with improvements in or relating to traffic control systems, to circuits for use in such systems, and to safety circuits having more general applications to electric currents in which action must be taken upon the presence of a malfunction in the circuit.

REVIEW OF THE PRIOR ART

It is now known to provide traffic control systems consisting of a master control unit, and one or more slave units controlled by the master unit, in which the communication between the units in order to obtain a desired sequence of light signals is by means of radio wave transmissions from the master unit, and as examples may be mentioned those disclosed in U.S. Pat. Ser. Nos. 2,829,362 and 3,168,685. A problem peculiar to such systems using broadcast radio waves as the control signal is the possibility of spurious signals, however caused, modulating the broadcast signal and causing a malfunction, such as the lighting of a green signal at an inappropriate part of the traffic control cycle. Such a possibility is of course particularly worrying with a traffic control system, in view of the potentiality of serious damage, unjury and possible loss of life if the malfunction results in a vehicle collision.

DEFINITION OF THE INVENTION

It is an object of the invention to provide a new traffic control system in which the possibility of malfunction by spurious signal interference is considerably reduced.

It is another object to provide such a system in which features such as a flashing amber (caution) signal and low battery voltage indication are readily provided.

It is a further object to provide a lamp safety circuit that will disable the green signal in a non-resettable manner upon the green (go) signal being actuated together with one of the red (stop) and amber signals.

In accordance with the present invention there is provided a traffic control system, comprising:

(A) a transmitter unit including:

(1) circuit means for transmitting a carrier signal (2) circuit means for selectively modulating the carrier signal with a first modulation signal at a first frequency, and (3) circuit means for selectively modulating the carrier signal with a second modulation signal at a second frequency different from the first frequency, and (B) a receiver unit for receiving the transmitted carrier signal and any modulation thereof by said first and second modulation signals and adapted to produce in response to receipt of the carrier signal modulated by both modulation signals and in cyclic sequence display of green, amber and red visual traffic signals, the receiver including:

(1) a first detector detecting the said first modulation signal and producing a corresponding first control signal, (2) a second detector detecting the said second modulation signal and producing a corresponding second control signal, and (3) receiver circuit means requiring receipt of both said first and second control signals for longer than a predetermined period and responsive to such receipt to cause display of the green visual traffic signal, (C) wherein the transmitter includes circuit means for generating a pulse of the said carrier modulated by said first and second modulation signals, which pulse is of a period shorter than the said predetermined period required for the said display of the green visual signal, and wherein the receiver circuit means is responsive to receipt of both said first and second control signals for a period longer than the said pulse to cause the said display of the green visual signal, is responsive to cessation of receipt of at least one of said control signals to cause display of the amber visual signal, and is responsive to receipt of the said pulse to cause display of the amber visual signal without prior display of the green visual signal.

Also in accordance with the invention there is provided a traffic control system comprising:

(A) a transmitter transmitting a control signal for control in a receiver of the display by the receiver in cyclic sequence of green, amber and red visual traffic signals, and (B) at least one said receiver receiving the said control signal and responsive thereto to cause the said display;

(C) the transmitter including circuit means for generating and transmitting a green form of said control signal adapted to cause display by each said receiver receiving the said green form control signal of said green visual signal, and for generating and transmitting a pulse of said green form of the control signal of period considerably shorter than that required for said cyclic display of the green visual signal;

(D) each said receiver including circuit means responsive to receipt of said green form of the control signal for a period longer than the said pulse to cause the said cyclic display of the green visual signal, responsive to cessation of said green form of the control signal to cause display of the amber visual signal, and responsive to receipt of said pulse to cause display of the amber visual signal without prior display of the green visual signal.

Further in accordance with the invention there is provided a traffic control system including:

a system unit comprising means for causing display thereby in cyclic succession of a green and a red visual signal respectively from green and red visual signal display means, the unit comprising:

a non-resettable circuit opening member electrically connected in series with the green visual display means for passage therethrough of the current required to display the green visual signal, circuit means connected to the non-resettable member and responsive to display of the red visual signal while the green visual signal is also displayed to apply to the member an additional current sufficient to activate the member to open the circuit including the green visual signal means so that the green visual signal can no longer be displayed.

DESCRIPTION OF THE DRAWINGS

Traffic control systems and circuits for use in such control systems which are particular preferred embodiments of the invention will now be described by way of example, with reference to the accompanying diagrammatic drawings, wherein.

DESCRIPTION OF THE PREFERRED EMBODIMENTS

Figure 3:
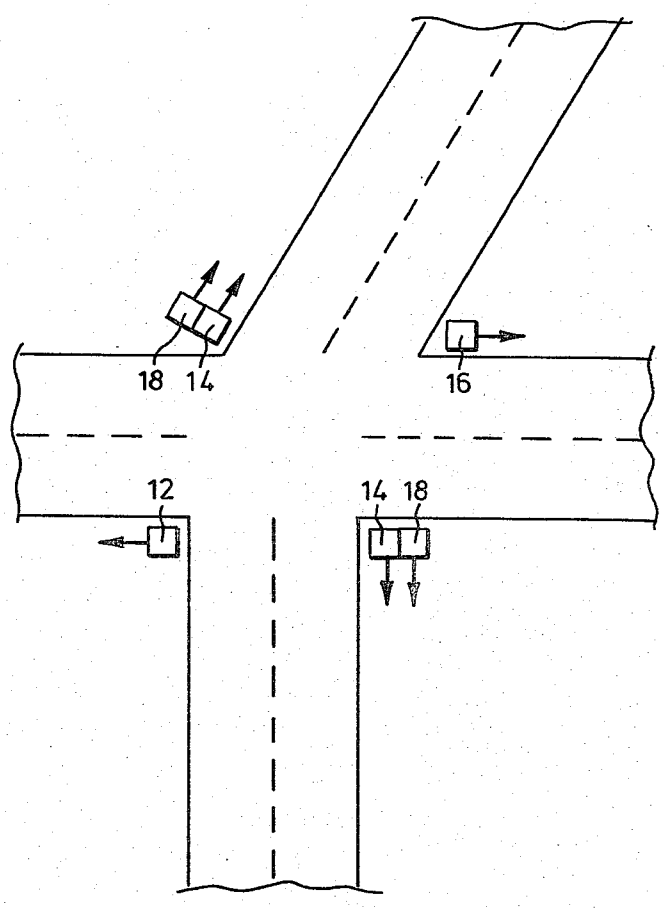
FIG. 3 illustrates an application for a four-way, two-road intersection employing a transmitter unit, a slave unit for the transmitter unit, and two pairs of receiver units, one receiver unit of each pair providing a left-turn signal only.
Figure 2:
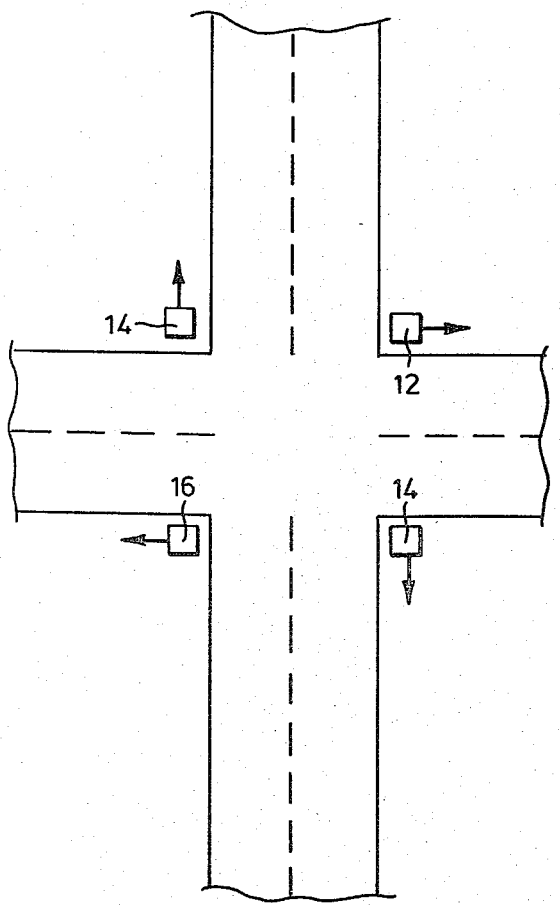
FIG. 2 illustrates a typical application for a four-way two-road intersection requiring a transmitter unit, a slave unit for the transmitter unit, and two receiver units.
Figure 1:
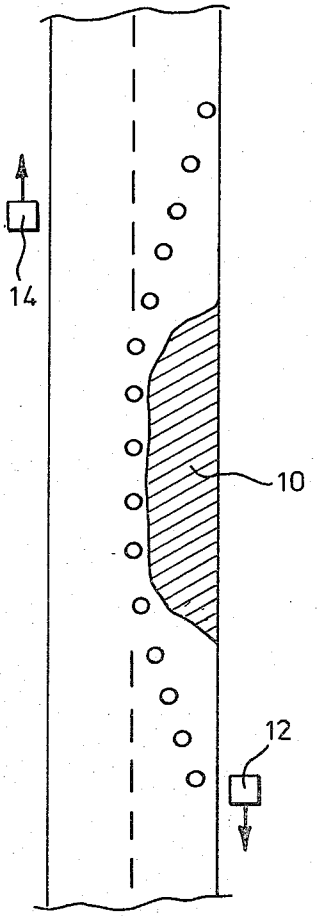
FIG. 1 illustrates a typical control system application for a two-lane road requiring a master transmitter unit and a single receiver unit.

FIGS. 1 to 3 show typical applications of trafic control systems of the invention, FIG. 1 illustrating the most common, namely a two-lane road in which one lane has an obstruction 10. Traffic from one direction is therefore directed by a transmitter unit 12, while traffic from the other direction is directed by a receiver unit 14, controlled by the transmitter unit 12 to operate is known opposite sequences of the green, and red visual indication lights with which both transmitter and receiver are provided. In these embodiments both units are also provided with a respective amber light operated in known manner in sequence with the green and red lights. Although in the embodiments the transmitter unit is equipped with its own set of visual indication lights, it will be apparent that this need not always be the case and a transmitter unit of the invention without such lights can control the necessary number of light-equipped receiver units.

In the four-way, two-road intersection application of FIG. 2 the transmitter unit 12 controls a slave receiver unit 16 at the opposite corner to show the same light sequence, while two receiver units 14 at the remaining two opposite corners are operated simultaneously in the required opposite sequence by the transmitter unit. The application illustrated by FIG. 3 corresponds to that of FIG. 2, but requires two additional receiver unit 18 operated in parallel to the receiver units 14, and controlled by the transmitter unit 12 to direct advanced left turns.

A typical single-phase sequence for the application of FIGS. 1 and 2 has the following periods which follow one another in cyclic sequence.

| Period | Signal |
|---|---|
| A | All lights red to clear single available lane of traffic in both directions. |
| B | Transmitter 12 and slave receiver 16 lights green. Receiver 14 lights remain red. |
| C | Transmitter 12 and slave receiver 16 lights amber. Receiver 14 lights remain red. |
| D | All lights red to clear the lane. |

-continued

| Period | Signal |
|---|---|
| E | Receiver 14 lights green - transmitter 12 and slave receiver 16 lights red. |
| F | Receiver 14 lights amber - transmitter 12 and slave receiver 16 lights red. |
| G | All lights red - this period merging with and being followed immediately by period 20 to repeat the single phase cycle. |

A two phase sequence for the application of FIG. 3 includes the following added periods following immediately after period 26.

| | |
|---|---|
| H | Receiver 18 lights green to permit traffic to turn. Transmitter 12, receiver 14 and slave receiver lights red. |
| I | Receiver 18 lights amber, all others red. |
| J | All lights red - this period merging with and being followed immediately by the period 20 to repeat the two phase cycle. |

Periods G and J also function to allow synchronisation of the cycle to ensure that at the beginning of the next period A all of the transmitter and receivers have switched to red.

Before proceeding to describe the specific circuits employed in a transmitter and a receiver embodying the invention, it is desirable to explain the general mode of operation of a traffic control system of the invention.

The transmitter broadcasts a continuous radio carrier signal of a frequency usually in the range about 100–200 Mhz, and of a power to permit good reception by the associated receivers without interfering with other adjacent systems. If this carrier stops owing to transmitter malfunction then the transmitter and all receivers will automatically begin to flash their red lights. The carrier signal is modulated by a first sustained pilot modulation signal at a first frequency usually in the low audio range 250–1000 hz, and any receiving unit receiving such a modulated carrier signal will show a steady red light, but cannot show a green light. Any cessation of this first pilot signal, whether or not accompanied by or caused by cessation of the carrier, will cause the above-mentioned flashing red signal.

If the carrier signal received by a receiver is modulated by a combination of both the first pilot signal and a second modulation signal different from the first pilot signal and appropriate to the receiver receiving it then, and only then, this "green" form of the control signal will cause that receiver to show a green light. Receipt of the carrier and the second modulation signal without the pilot signal will also result in a flashing red light.

The cessation of the green form signal combination to show a green light automatically caused the lighting of an amber light for a predetermined period of time, when such an amber light is provided, and this feature can be employed to produce a "flashing amber" condition by transmitting the green form signal as a brief pulse that is not long enough to light the green light, but is long enough for the receiver circuit to consider that the green light has been turned on and then turned off, so that the amber light is turned on.

Such systems must usually be operated by batteries and the circuit includes a "low battery" detector that will automatically cause a flashing red condition, indicating that there is a malfunction requiring the attention of a serviceman.

The most dangerous possible condition is one in which the green light of any unit is left permanently on, and each circuit includes circuit means that under this condition will break a fusible link extinguishing the green light completely, so that the attendance of a serviceman is required.

Figure 4:
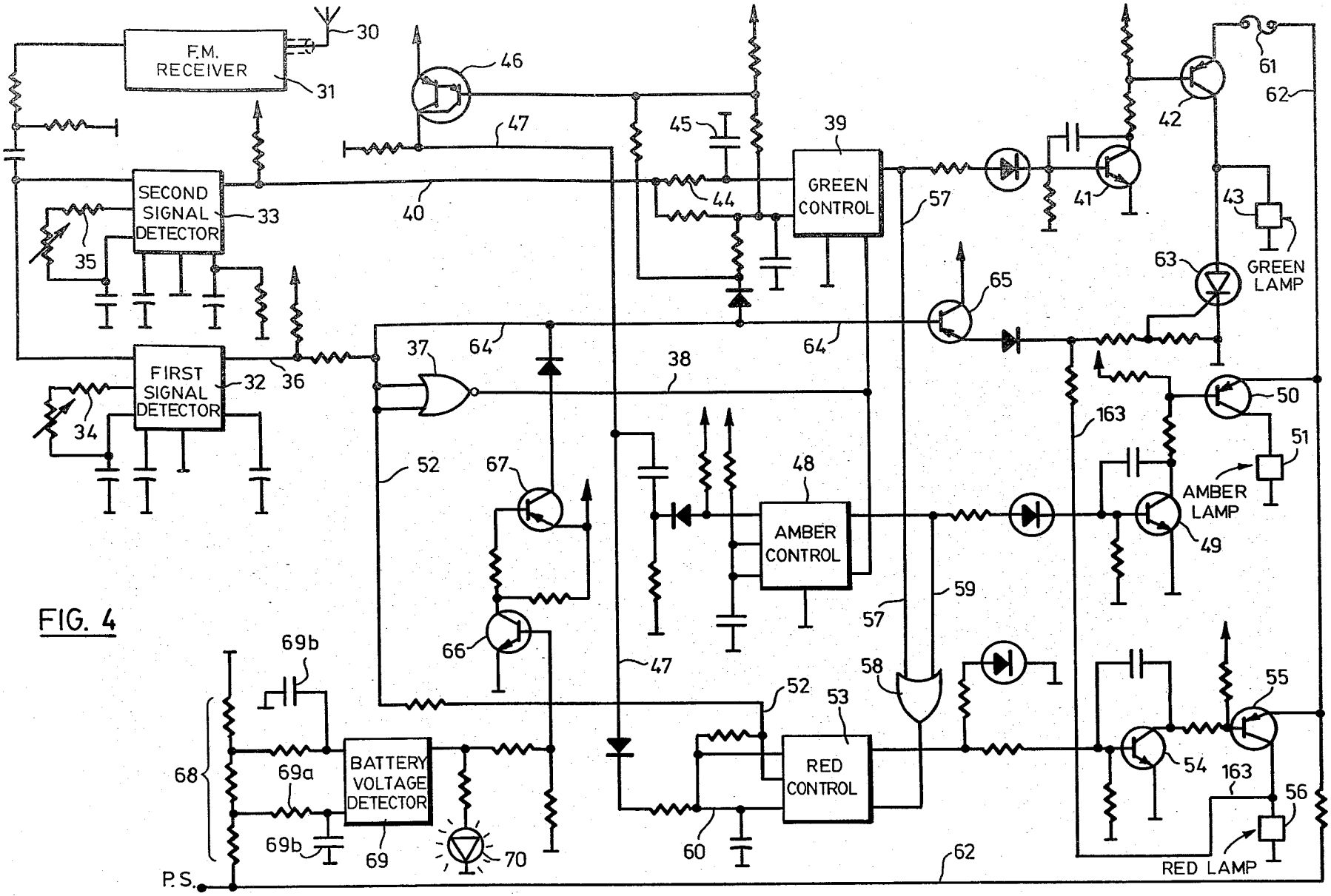
FIG. 4 is a circuit diagram of a receiver unit of the invention including a set of traffic indicator lights, and FIGS. 5*a*, 5*b* and 5*c* together are a circuit diagram of a transmitter unit of the invention which also includes its own set of traffic indicator lights.
Figure 5A:
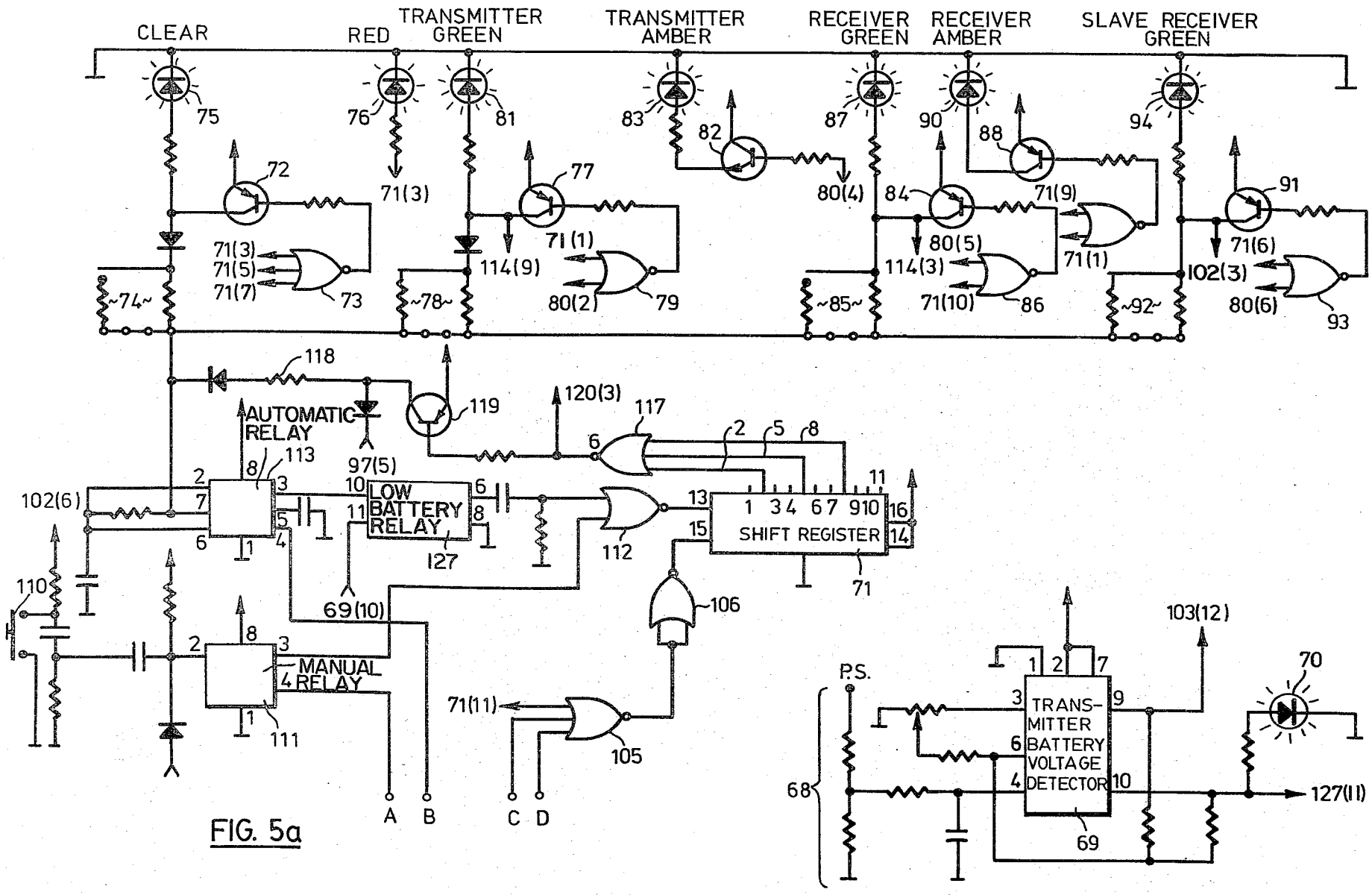
Figure 5B:
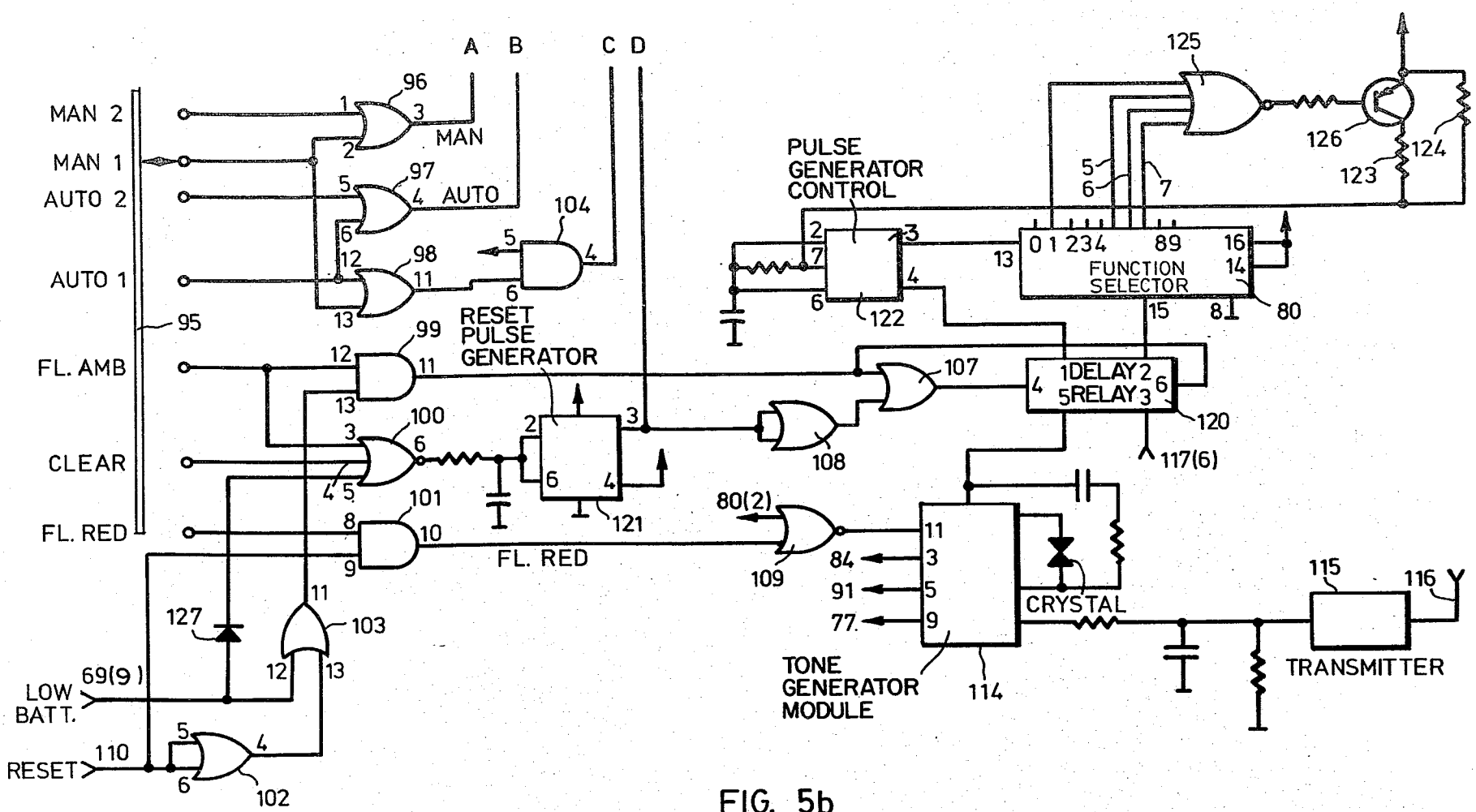
Figure 5C:
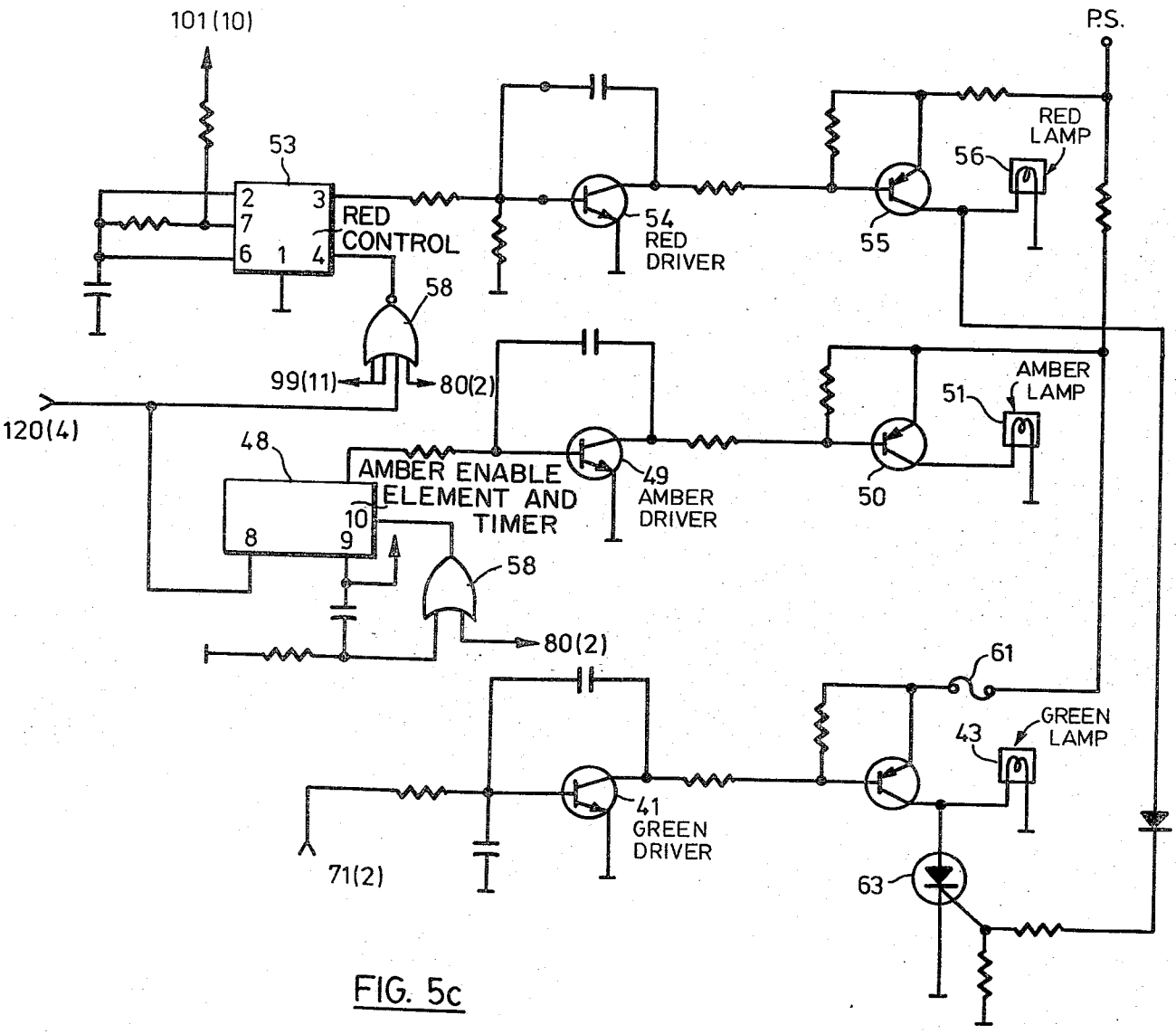

The operation of a typical receiving unit of a system of the invention will first be described and attention is therefore directed to FIG. 4 showing a circuit for such a receiving unit. It will be understood that only certain of the components of the circuit will be specifically referred to, namely those necessary to explain the operation of the invention, and that the circuit will include numerous other components such as resistors, capacitors, diodes, etc. required for its proper operation, which will be apparent to person skilled in the art and not needing specific description. Similarly test points and connections to the power supply will not be indicated unless necessary.

The frequency modulated carrier signal transmitted by the single transmitter is received by antenna 30 of the receiver, usually mounted on top of the pole carrying the lights for the best reception, and passes to a narrow band F.M. receiver 31, the output of which is fed to a detector 32 for the first pilot signal and a detector 33 for the second pilot signal. Conveniently the modulation signals are in the audio range and in a specific example the first pilot signal may be about 370 Hz, while the second signals for the three different possible receivers may be, for example, about 475 Hz for receiver 14, about 575 Hz for receiver 18, and about 660 Hz for slave receiver 16, these intervals being sufficient for detection without error. The audio frequencies detected by detectors 32 and 33 are set principally by resistors 34 and 35 respectively.

If the pilot signal is present detector 32 feeds a signal via connection 36 to an inverter 37 which in turn feeds an enabling signal via a connection 38 to a green control circuit element 39, consisting of for example an NE 555 timer module of signetics. If the second signal is also present then detector 33 feeds another signal via connection 40 directly to the green control circuit element 39, which with the enabling signal also received is turned on and latches on, whereupon it now can activate control transistor 41 to activate power transistor 42 and light the green light 43, receiving the power from power source P.S. The element is reset when only the enabling signal is received. The signal from detector 33 to element 39 passes through a delay circuit consisting of resistor 44 and capacitor 45, which delays the enabling of element 39 and lighting of green light 43 until is is certain that the green light is required, as will be explained below.

The green-on signal fed via connection 40 to the element 39 is also fed to transistor 46 and when this signal stops the transistor 46 feeds a signal via connection 47 to an amber control circuit element 48, also consisting of an NE 555 timer module, which when latched on activates control transistor 49 to switch power transistor 50 and light the amber light 51. This is the only way in which the amber light can be switched on and there is no independent connection from the detector 33 to the amber enabling element 48, although this element must also be enabled by the signal from detector 32 via connection 38. Since the element 48 is also a timing element it enables the control transistor 49 etc for a period of about 5 seconds and then will shut off to extinguish the amber light. The amber light will also be shut off before the period set by the element 48 if the pilot signal is discontinued, removing the enabling signal that is received from the respective detector 32, whereupon the element 48 is reset to time a new "amber-on" signal. The amber light is therefore positively extinguished from the transmitter by removal of the enabling signal and this is arranged to take place shortly before the element 48 times out.

It will now be seen that a condition of "flashing amber" can be established in each receiver by switching on the second signal from detector 33 by means of a pulse from the transmitter of length less than the time period set by resistor 44 and capacitor 45; the green light will not light because the pulse is not of sufficient length but the transistor 46 will operate to enable the amber light control 48 to light lamp 51 for a period that can be set by the pilot signal or by the timer or control 48.

A pilot signal detected by detector 32 is fed by connections 36 and 52 to a red control circuit element 53, also consisting of a NE 555 timer module, which if enabled, can activate control transistor 54 to activate power transistor 55 and light red light 56. The "green on" signal from element 39 to green control transistor 41 is also fed via connection 57 to an OR logic element 58, while the "amber on" signal from element 48 is also fed via connection 59 to the OR logic element 58, and the resultant output from element 58 is fed to element 53 to inhibit the lighting of the red light 56 until both green and amber lights are extinguished, so as to prevent any possibility of two lamps being lit simultaneously. It will be noted that the element 53 also receives the "green off" signal from the transistor 46 via connections 47 and 60 and this signal is employed to delay the possibility of red being switched on for a period of say 3 seconds, so as to avoid the possibility of the red light being switched on, for example during flashing amber, because the circuit would consider the end of the short amber a signal to switch on the red light, the pilot signal then being absent.

The most dangerous condition for a traffic control system is of course for a green light to be lit when it should not be, since with red or amber showing a motorist will proceed with caution. To avoid this possibility a fusible link 61 is provided between main battery connection 62 and the collector of green power transistor 42. While the green light is on power is fed to the anode of an SCR element 63; when the red light is on power is fed to the exciter electrode of the SCR element 63 via connection 163; if both lights are on simultaneously then SCR element 63 will conduct and the additional power passing through transistor 42 will break the fusible link 61, so that the green light cannot again come on until a serviceman has checked the unit, removed the cause of the malfunction and replaced the fusible link.

Similarly, if the pilot signal from the detector 32 is absent then the green light should not be on. To avoid this possibility the output of the detector 32 is also fed via connection 64 to the base of the transistor 65 and each time that the pilot signal ceases after the amber signal has been turned off by turning off the green signal the transistor 65 applies a trigger signal to the exciter of the SCR element 63; if the green light is still on then the SCR element will conduct and the link will break.

A special situation exists when the receiver unit is first switched on, especially if at that time the transmitter is not operating to provide a carrier and pilot signal. In the absence of a pilot signal from detector 32 feeding via connection 52 to the red control element 53, the element will proceed to flash the red light at a preset frequency determined by the components of the element 53; an inhibit signal for elements 39 and 48 is derived from the inverter 37; the signal also feeds to transistor 65 to ensure that green does not light.

Upon first switching on the battery its voltage is applied across a potential divider 68 and a battery voltage detector 69 detects whether the voltage is sufficient for satisfactory operation. A suitable module for the detector 69 is also an NE 555 which contains a comparator circuit and a voltage reference. Transistors 66 and 67 amplify the output of battery voltage detector 69 to a suitable level for operation of the circuits to which it is applied. If the voltage is not sufficient then an indicator lamp 70 is lit and the element 53 flashes the red light as the most satisfactory signal for safety, and also to conserve the remaining battery energy as much as possible. The voltage fed to the element 69 is delayed by RC elements **69*a* and 69*b* by about ten seconds, so that the receiver will always begin to flash red and will therefore be preset to this condition. If after ten seconds the voltage is satisfactory then the signal from element 69 disappears and the circuit is not controlled by the pilot signal, if present, and otherwise will remain flashing red. With the pilot tone present elements 39 and 48 are enabled, but any second signal from detector 33 is delayed by RC elements 44 and 45** until that signal has persisted for more than a few seconds, proving that it is required.

Having described the manner of operation of a typical receiver unit, the operation of a typical transmitter unit of the invention will now be described. As mentioned above, it is preferred that a transmitter unit be combined with a set of lamps, and any part of transmitter circuit corresponding to the same part of the receiver circuit will be given the same reference number. In order for the circuit connections to be identified the terminals of some of the elements are themselves given reference numbers and a connection to that terminal will be identified by the reference number of the element with the number reference of the terminal given in parentheses after the principal reference, e.g. a connection to terminal 9 of element 114 is identified 114(9).

The automatic selection of the sequence of operation of the various lights is controlled by shift register 71 operating as a stepping selector, with provision for manual control. When the circuit is first switched on the low battery detector circuit 69 is operative, as with the receiver and its output is fed to a low battery relay 127, consisting of an OR gate (e.g. CD4001B of RCA), but with a longer initial period of about 30 seconds to permit the transmitter to stabilize. The output of the relay 127 is fed to OR gate 112 together with the output from an element 111 described below. The time periods A through J above are set by a plurality of timing circuits which are made controllable as necessary. The clear periods A, D, G and J when all lights are red are controlled by transistor 72 which is switched on via gate 73 controlled by the selector 71; the length of time for which the transistor is switched on is controlled by a multi-position variable resistor 74, a lamp 75 indicating that the transistor is on. No separate timing is required for transmitter only red, as shown by indicator light 76, since this must be the converse of the receiver green, and the light is controlled directly from red control element 53.

Transmitter green period B is controlled by a transistor 77, its switch-on time being determined by a multi-position variable resistor 78, and its switch on being controlled by a gate 79 under the control of both the step selector 71 and a function selector 80 to be described below; an indicator lamp 81 is provided. The amber period C is fixed in length, as was described above, and initiated by switching off green, so that the transistor 82 is connected directly to amber control element 48, an indicator lamp 83 being provided.

Receiver green period E is controlled by transistor 84 using multi-position variable resistor 85 and via a gate 86 connected to the selectors 71 and 80, an indicator lamp 87 being provided. The amber period F is controlled by transistor 88 via gate 89 and uses indicator lamp 90. Finally, when a second receiver 18 is provided requiring a different length of green signal, this period H is controlled by transistor 91 using multi-position variable resistor 92 and via gate 93 to light lamp 94. Each of the transistors 77, 84 and 91 must be connected to other circuit elements of the transmitter, as must the gates 73, 79, 86 and 93, and these connections are indicated as described above.

The mode of operation of the transmitter is selected from among the following possibilities by operation by a rotatable multi-position switch 95 via logic modules 96 to 109. The switch has the following positions, the location of the switch in each position feeding a signal to the appropriate logic module to cause the required selection.

Manual 1 in which the single phase sequence is obtained under the control of a pushbutton 110, operation of this pushbutton causing operation of manual pulse generator circuit element 111 (e.g. NE 555 Timer module of Segretics) if this element has been enabled by logic module 96, whereupon the pushbutton impulses from generator 111 are fed via gate 112 to the step selector 71;

Manual 2 in which the two phase sequence is obtained via the operation of logic modules 98, 104, 105 and 106 to give the necessary control signals to selector 71;

Automatic 1 in which the 1 phase sequence is obtained automatically under the control of automatic pulse generator circuit element 113 (e.g. another NE 555 module), which has been enabled by logic module 97, while manual pulse generator 111 is now disabled so that the pushbutton 110 is ineffective;

Automatic 2 in which the 2 phase sequence is obtained automatically;

Amber flash in which all amber lights will be flashed by momentary turn-on of green, as described above and in detail below.

All clear in which all lights will stay indefinitely at red until another function is selected, and Red flash in which all lights will be red and flash.

For example, with the switch 95 at Automatic 1 and clear period A in effect a tone generator module 114 is operative and produces the first signal which is fed to the F.M. transmitter 115 to modulate its output, so that the necessary "red" signal is broadcast from the antenna 116. When the selector moves to period B the transistor 77 is operative and the tone generator responds by producing the second modulation signal, so that the F.M. signal is now modulated by both signals and corresponding signals will be produced at the detector circuits 32 and 33 of any slave receivers 16 that have been included in the system, so that these slave receivers will show green together with the transmitter, whose green driver has been actuated by selector 71. This second modulating signal does not affect any of the receivers 14 and 18, so that they will light their red lights.

When the selector moves to period E the transistor 84 is operative and the generator 114 produces a second modulation that will be detected by the detectors 33 of the receivers 14 and cause them to show green. Similarly, when the selector moves to period H of a two phase sequence, the transistor 91 is operative and the generator 114 produces a second modulation that will be detected by the detectors 33 of the receivers 18.

Whenever an amber light is called for in the sequence by selector 71 then gate 117 is operative for a fixed period set by the value of a resistor 118 connected to the collector of transistor 119. The output from the transistor base goes to a flip-flop relay circuit element 120 (e.g. CD 4013B of RCA) which then sends a pulse signal from a pulse generator control element 112 (e.g. an NE 555 timer module of Signetics) to the tone generator 114 to cut the first pilot modulation so that all the amber lights in all the receivers are cut simultaneously to red despite the different timings that are possible; at the same time the transmitter's own amber control element is disabled for the same purpose.

The flashing red produced when the battery voltage is low is caused by the switch module 100 which is fed from the battery circuit when this condition is detected; this switch module controls a pulse generator circuit element 121 (an NE 555 module of Signetics) which produces a reset pulse that is fed via gate 105 and inverter 106 to the shift register selector 71 to reset the sequence to the sequence start period A which is clear with all lights red. At the same time the reset pulse signal feeds to the gates 102, 103 and 99–101 to reset them, the gate module 101 operating through gate module 109 to remove the first modulating tome so that the receivers will all flash red. The module 99 operates through module 107 and relay element 120 and gate 58 to flash the red light of the transmitter itself.

Flashing amber set by the switch 95 is produced by the switch module 100 operating through the pulse generator element 121 to give permanent reset and thereby inhibit the operation of the selector 71. This function requires the transmission of three green form signal pulses at the respective frequencies followed by removal of the pilot signal. These green signals must be generated and transmitted sequentially since it is possible to generate only two signals simultaneously (pilot plus one other). The required timing pulses are generated by shift register element 80 under the control of the pulse generator control element 122 which advances the shift register selector 80 with a pulse repetition rate determined by resistor 123 and/or 124. Until flashing amber is selected register element 80 is held reset and pulse generator control element 122 is inhibited by flip-flop relay element 120; upon such selection relay element 120 after a delay releases its reset of element 80 and enables pulse generator element 122 which immediately produces a pulse and advances register element 80. Gate element 125 connected to pin 1 now turns on transistor 126 which adds resistor 123 to the control of pulse generator 122, which produces another pulse after a predetermined period which in this embodiment is 140 milliseconds (ms) to advance registor 80 to pin 2. During this 140 ms period the pilot tone output of generator 114 is disabled via gate 109 but this has no effect on the receivers. With the output of register 80 at pin 2 the rate of pulse generator 122 is set by resistor 124 only and it will advance register 80 to pins 3, 4 and 5 after longer successive periods of 250 ms. When pin 5 is reached another 140 ms long signal is obtained and the transmitter slave green tone signal is enabled through gate element 79 and transistor 77. When pin 6 is reached after 140 ms the receiver 14 green tone signal is enabled through gate 86 and transistor 84. Similarly when pin 7 is reached after another 140 ms period the slave receiver 18 green tone signal is enabled through gate 93 and transistor 91. As each receiver green tone pulse signal is generated the appropriate receiver amber light will be lit in the described sequence. The shift register will require 3 times 250 ms or a total of 750 ms to shift to pins 8, 9 and back to 0 and all of the amber lamps will be on for this period. Now pin 1 is selected for 140 ms which, as described above, will remove the pilot tone and extinguish all receiver amber lights simultaneously. The period between pins 1 and 5 is also 750 ms so that the amber lights will remain off for this period, and the cycle will then repeat with the amber lights turned on sequentially at intervals of 140 ms. When the operator moves the switch 95 away from flashing amber the elements 107 and 108 allow the next pulse that moves the selector to pin 2 to reset element 120 which returns elements 80 and 122 to their original condition after the amber lamps have been all extinguished subsequent to selection of pin 1.

During any manual or automatic sequence when the selector element 80 is in use it is necessary to extinguish the receiver amber lights and this is done by removal of the pilot tone. This is accomplished by allowing element 120 to release its reset of element 80 and to enable element 122 by using the signal from element 117 to flip element 120; element 122 now shifts register 80 from pin 0 to pin 1 and in 140 ms to pin 2; when pin 2 is selected element 120 is reset through gate elements 107 and 108 but while pin 1 was selected the pilot tone was removed and all amber lights were extinguished simultaneously.

When flashing red is selected on the switch 95 pin 10 of switch module 101 feeds a signal to module 109 and this removes the pilot tone produced by generator 114. The signal at pin 6 of module 100 starts timer 121 which after a few seconds produces a reset signal which resets element 80 to clear via modules 105 and 106. This clear signal enables red driver 53 which is also a timing circuit with a 50% duty cycle and a rate of 1.5 seconds. Normally this timing function is inhibited but for flashing red a signal is taken from pin 10 of module 101 to pin 7 of driver 53 which enables the timer and causes the transmitter red light to flash. When low battery is detected a signal from pin 10 of battery voltage detector 69 is fed through a diode 127 to the flashing red connection on the switch 95.

We claim:

1. A traffic control system comprising:

(A) a transmitter unit including:

(1) circuit means for transmitting a carrier signal (2) circuit means for selectively modulating the carrier signal with a first modulation signal at a first frequency, and (3) circuit means for selectively modulating the carrier signal with a second modulation signal at a second frequency different from the first frequency, and (B) a receiver unit for receiving the transmitted carrier signal and any modulation thereof by said first and second modulation signals and adapted to produce in response to receipt of the carrier signal modulated by both modulation signals and in cyclic sequence display of green, amber and red visual traffic signals, the receiver including:

(1) a first detector detecting the said first modulation signal and producing a corresponding first control signal, (2) a second detector detecting the said second modulation signal and producing a corresponding second control signal, and (3) receiver circuit means requiring receipt of both said first and second control signals, for longer than a predetermined period and responsive to such receipt to cause display of the green visual traffic signal, (C) wherein the transmitter includes circuit means for generating a pulse of the said carrier modulated by said first and second modulation signals, which pulse is of a period shorter than the said predetermined period required for the said display of the green visual signal, and wherein the receiver circuit means is responsive to receipt of both said first and second control signals for a period longer than the said pulse to cause the said display of the green visual signal, is responsive to cessation of receipt of at least one of said control signals to cause display of the amber visual signal, and is responsive to receipt of the said pulse to cause display of the amber visual signal without prior display of the green visual signal.

2. A traffic control system as claimed in claim 1, wherein the said receiver circuit means is responsive to receipt of only either said first or said second modulation signal to cause display of the red visual traffic signal.

3. A traffic control system as claimed in claim 2, wherein said receiver circuit means is operative upon receipt of only said second control signal to cause display of a steady red visual traffic signal, and is operative upon receipt of only said first control signal to cause display of a flashing red visual traffic signal.

4. A traffic control system as claimed in claim 1, wherein the said receiver circuit means includes delay means to which at least one of the first and second control signals are fed to initiate display of the green visual signal, the said delay means delaying the application of the respective signal and thereby delaying display of the green visual signal for a period of time longer than the said pulse.

5. A traffic control system as claimed in claim 1, wherein the receiver circuit means includes a timer initiated in a timing cycle by cessation of said receipt of at least one of the said control signals to control the length of time of display of the amber visual signal.

6. A traffic control system as claimed in claim 1, wherein the receiver circuit means is responsive to cessation of the first control signal to terminate display of the amber visual signal.

7. A traffic control system as claimed in claim 1, wherein the receiver circuit means includes, a green control circuit portion producing a green enabling signal for display of the green visual signal, and a red control circuit portion producing a red enabling signal for display of the red visual signal, and wherein the green enabling signal is fed to the red control circuit portion to prevent the display of the red visual signal, until the green visual signal is no longer displayed.

8. A traffic control system as claimed in claim 1, wherein the receiver circuit means includes, a green control circuit portion producing a green enabling signal for display of the green visual signal, an amber control circuit portion producing an amber enabling signal for display of the amber visual signal, and a red control circuit portion producing a red enabling signal for display of the red visual signal, and wherein the green and amber enabling signals are fed to the red control circuit portion to prevent display of the red visual signal until the green and amber visual signals are no longer displayed.

9. A traffic control system as claimed in claim 1, wherein the receiver circuit means includes, a green control circuit portion producing a green enabling signal for display of the green visual signal, and a green off signal as the green visual signal is no longer displayed, an amber control circuit portion producing an amber enabling signal for display of the amber visual signal, and a red control circuit portion producing a red enabling signal for display of the red visual signal, and wherein the green off signal is fed to the red control circuit portion to prevent display of the red visual signal for a period after the green visual signal is no longer displayed and during which period the amber visual signal is displayed in a flashing operation.

10. A traffic control system as claimed in claim 1, wherein the receiver unit includes:

a non-resettable circuit operating member electrically connected in series with the green visual signal for passage therethrough of the current required to display the green visual signal, circuit means connected to the non-resettable member and responsive to display of the red visual signal while the green visual signal is displayed to apply to the member an additional current sufficient to activate the non-resettable member to open the circuit including the green visual signal so that the green visual signal can no longer be displayed.

11. A traffic control system as claimed in claim 10, wherein said non-resettable member is a fusible link, and said circuit means connected to the member comprise an SCR device having an electrode thereof connected to the fusible link in parallel with the green visual signal, and having its gate electrode supplied with control current while the red visual signal is displayed.

12. A traffic control system as claimed in claim 1, wherein the receiver unit includes, a non-resettable circuit member electrically connected in series with the green visual signal for passage therethrough of the current required to display the green visual signal, circuit means connected to the non-resettable member and responsive to cessation of the said first control signal to apply to the member after a predetermined interval an additional current sufficient to actuate the member to open the circuit including the green visual signal if the green visual signal is still displayed so that the green visual signal can no longer be displayed.

13. A traffic control system as claimed in claim 1, wherein said receiver unit includes, a green control circuit portion causing a green enabling signal for display of the green visual signal, a red control circuit portion causing a red enabling signal for display of the red visual signal, and a generator operating at a predetermined frequency to feed a control signal to the red control circuit portion to display the red visual signal and flash it at said predetermined frequency, and to feed an inhibit signal to the green control circuit portion to ensure that the green visual signal is not displayed.

14. A traffic control system as claimed in claim 13, wherein said receiver unit includes circuit means for detecting the voltage of a power supply for the receiver, said circuit means being responsive to reduction of said voltage below a predetermined value to actuate the said generator and flash the red visual signal.

15. A traffic control system comprising:

(A) a transmitter transmitting a control signal for control in a receiver of the display by the receiver in cyclic sequence of green, amber and red visual traffic signals, and (B) at least one said receiver receiving the said control signal and responsive thereto to cause the said dispaly;

(C) the transmitter including circuit means for generating and transmitting a green form of said control signal adapted to cause display by each said receiver receiving the said green form control signal of said green visual signal, and for generating and transmitting a pulse of said green form of the control signal of period considerably shorter than that required for said cyclic display of the green visual signal;

(D) each said receiver including circuit means responsive to receipt of said green form of the control signal for a period longer than the said pulse to cause the said cyclic display of the green visual signal, responsive to cessation of said green form of the control signal to cause display of the amber visual signal, and responsive to receipt of said pulse to cause display of the amber visual signal without prior display of the green visual signal.

16. A traffic control system as claimed in claim 15, wherein each said receiver circuit means includes delay means to which the said green form of the control signal is fed to initiate display of the green visual signal, the said delay means delaying the display of the green visual signal for a period of time longer than the said pulse.

17. A traffic control system as claimed in claim 15, wherein each said receiver circuit means includes a timer initiated in a timing cycle by cessation of receipt of said green form of the control signal to control the length of time of display of the amber visual signal.

18. A traffic control system as claimed in claim 15, wherein each said receiver circuit means includes, a green control circuit portion producing a green enabling signal for display of the green visual signal, and a red control circuit portion producing a red enabling signal for display of the red visual signal, and wherein the green enabling signal is fed to the red control circuit portion to prevent the dispaly of the red visual signal until the green visual signal is no longer displayed.

19. A traffic control system as claimed in claim 15, wherein each said receiver circuit means includes, a green control circuit portion producing a green enabling signal for display of the green visual signal, an amber control circuit portion producing an amber enabling signal for display of the amber visual signal, and a red control circuit portion producing a red enabling signal for display of the red visual signal, and wherein the green and amber enabling signals are fed to the red control circuit portion to prevent display of the red visual signal until the green and amber visual signals are no longer displayed.

20. A traffic control system as claimed in claim 15, wherein each said receiver circuit means includes, a green control circuit portion producing a green enabling signal for display of the green visual signal, and a green off signal as the green visual signal is no longer displayed, an amber control circuit portion producing an amber enabling signal for display of the amber visual signal, and a red control circuit portion producing a red enabling signal for display of the red visual signal, and wherein the green off signal is fed to the red control circuit portion to prevent display of the red visual signal for a period after the green visual signal is no longer displayed and during which period the amber visual signal is displayed in a flashing operation.

21. A traffic control system as claimed in claim 15, wherein each said receiver unit includes, a non-resettable circuit operating member electrically connected in series with circuit means of the green visual signal for passage therethrough of the current required to display the green visual signal, circuit means connected to the non-resettable member and responsive to display of the red visual signal while the green visual signal is displayed to apply to the member an additional current sufficient to activate the member to open the circuit means of the green visual signal so that the green visual signal can no longer be displayed.

22. A traffic control system as claimed in claim 15, wherein each said receiver unit includes, a non-resettable circuit member electrically connected in series with circuit means of the green visual signal for passage therethrough of the current required to display the green visual signal, circuit means connected to the non-resettable member and responsive to cessation of the green form of the said control signal to apply to the member after a predetermined interval an additional current sufficient to actuate the member to open the circuit means of the green visual signal if the green visual signal is still displayed so that the green visual signal can no longer be displayed.

23. A traffic control system as claimed in claim 15, wherein each said receiver unit includes, a green control circuit portion causing a green enabling signal for display of the green visual signal, a red control circuit portion causing a red enabling signal for display of the red visual signal, and a generator operating at a predetermined frequency to feed a control signal to the red control circuit portion to display the red visual signal and flash it at said predetermined frequency, and to feed an inhibit signal to the green control circuit portion to ensure that the green visual signal is not displayed.

24. A traffic control system as claimed in claim 15, wherein each said receiver unit includes circuit means for detecting the voltage of a power supply for the receiver, said circuit means being responsive to reduction of said voltage below a predetermined value to actuate the said generator and flash the red visual signal.

* * * * *